US007422835B2

(12) United States Patent
Slater

(10) Patent No.: US 7,422,835 B2
(45) Date of Patent: Sep. 9, 2008

(54) IMAGING ELEMENT HAVING IMPROVED DURABILITY

(75) Inventor: Sean D. Slater, Meldreth (GB)

(73) Assignee: Eastman Kodak Company, Rochester, NY (US)

( * ) Notice: Subject to any disclaimer, the term of this patent is extended or adjusted under 35 U.S.C. 154(b) by 238 days.

(21) Appl. No.: 10/582,677

(22) PCT Filed: Nov. 25, 2004

(86) PCT No.: PCT/GB2004/004967

§ 371 (c)(1),
(2), (4) Date: Jun. 14, 2006

(87) PCT Pub. No.: WO2005/062123

PCT Pub. Date: Jul. 7, 2005

(65) Prior Publication Data

US 2007/0154822 A1 Jul. 5, 2007

(30) Foreign Application Priority Data

Dec. 24, 2003 (GB) ..... 0329925.2

(51) Int. Cl.
*G03C 8/00* (2006.01)

(52) U.S. Cl. ..... 430/201; 430/434; 430/523; 430/531; 430/539; 430/631; 430/633; 430/638; 430/961

(58) Field of Classification Search ..... 430/201, 430/434, 523, 531, 536, 539, 631, 633, 638, 430/961
See application file for complete search history.

(56) References Cited

U.S. PATENT DOCUMENTS

| | | | |
|---|---|---|---|
| 3,116,247 | A | 12/1963 | Moore et al. |
| 3,121,060 | A | 2/1964 | Duane |
| 5,019,491 | A | 5/1991 | Takeuchi |
| 5,667,950 | A | 9/1997 | Schmidt |
| 5,702,864 | A | 12/1997 | Pilot et al. |
| 6,153,363 | A | 11/2000 | Nair et al. |
| 6,194,130 | B1 | 2/2001 | Nair et al. |
| 6,274,298 | B1 | 8/2001 | Nair et al. |
| 6,346,369 | B1 | 2/2002 | Tsou et al. |
| 6,482,580 | B2 | 11/2002 | Morita |
| 6,573,011 | B1 | 6/2003 | Nair et al. |
| 6,713,224 | B1 | 3/2004 | Hill et al. |
| 2003/0158050 | A1 | 8/2003 | Kawasaki et al. |
| 2003/0162122 | A1 | 8/2003 | Nair et al. |

FOREIGN PATENT DOCUMENTS

| | | |
|---|---|---|
| EP | 0 352 067 | 1/1990 |
| EP | 0 615 158 | 9/1994 |
| EP | 1 052 542 | 11/2000 |
| EP | 1 069 470 | 1/2001 |
| EP | 1 069 471 | 1/2001 |
| EP | 1 122 595 | 8/2001 |
| GB | 982756 | 12/1962 |
| GB | 1 402 697 | 8/1975 |

OTHER PUBLICATIONS

JP abstract 01-107255 (Fuji) Apr. 25, 1989.
JP abstract 63-005339 (Konica) Jan. 11, 1988.
JP abstract 03-132754 (Konica) Jun. 6, 1991.

*Primary Examiner*—Richard Schilling

(57) ABSTRACT

The invention provides an imaging element comprising a support having thereon, in order, at least one imaging layer, at least one interlayer containing a lubricant which provides scratch-resistance and at least one outermost layer containing a different lubricant which provides abrasion-resistance and a method of processing the element. The element has increased durability, especially with regard to scratch- and abrasion-(especially photoabrasion-) resistance, whilst retaining performance and ease of manufacture. Preferably the element is for use in the manufacture of printed circuit boards or the production of printing plates, wherein abrasion and scratches are particularly acute.

20 Claims, No Drawings

IMAGING ELEMENT HAVING IMPROVED DURABILITY

FIELD OF THE INVENTION

This invention relates to imaging elements having improved durability and in particular to abrasion-resistant and scratch-resistant layers comprising a plurality of lubricants therein.

BACKGROUND OF THE INVENTION

Abrasion defects are defects that are individually of the order of several micrometers in width and sub-micrometer to micrometer in depth. They can be formed as a group and are sometimes referred to as 'scuff marks' and are commonly observed on the front and back sides of photographic films, particularly those used with printed circuit board (PCB) photomasks. They are caused by low-pressure sliding contact of dirt particles or rough surfaces in contact with imaging products. The defect can be purely cosmetic in that the usage of the product is not hindered but is totally unacceptable as it would give the impression of poor workmanship. Image information is contained within photographic films in the form of developed silver, whilst for other imaging elements it could be in the form of a diazo compound. If the scuff mark is severe, some of the image information can be lost making the medium useless.

Scratches are defects that also are micrometers in width but tend to be deeper than a scuff mark and tend to be present singly. They can also be formed on either side of an imaging medium, in particularly on PCB photomasks, and are caused by higher-pressure sliding or digging contact of objects when in contact with imaging products. Again this type of defect is particularly serious if part of the information contained within the image is lost as the medium now becomes useless.

A chucking abrasion is similar to the scratch described above but the dirt particles that cause the defect tend to wander over a small area of film in a random walk pattern. Such particles cause this type of damage when they are included within a stack of film with the films sliding about when the box of film is transported without vacuum packaging. Since the particle may wander over its own path, this defect is also termed a repetitive scratch defect.

Photoabrasion is a defect that occurs to a photographic film prior to processing or during processing. A scratch or an abrasion defect injures the film to the extent that the silver halide crystals become developable without the action of light. This defect shows up as a line or series of lines of developed silver in areas where no image was expected. This can make the photographic film useless for its intended purpose.

Thus it will be seen that abrasion-resistance and scratch-resistance protective coatings on the front or back or both sides of an imaging element are commonly required.

Black-and-white high contrast silver halide materials are used widely as originals for optical contact copying onto other photosensitive materials. For example in the printing industry, page separations are exposed by imagesetter onto film, which is then copied (exposed) onto printing plates by ultraviolet (UV) contact exposure. The exposed printing plate is then processed to produce an ink-receptive image for printing on a press. Sometimes pages are physically assembled by cutting and pasting images and text from various sources and the assembled page may then be copied by camera onto another sheet of film. A scratch defect in this film will remove image, leading to an unusable printing plate, and a photoabrasion defect will lead to an unwanted line on the plate.

Another example of this type of process is the manufacture of PCBs, wherein electronic circuit track layouts are exposed by photoplotter onto film intermediates, called phototools or photomasks. The photomask is positioned immediately adjacent to a copper-clad, resist-covered PCB substrate on a contact-copying frame. To improve the intimacy of contact it is normal practice to evacuate air from the contact frame. Incident radiation such as ultraviolet light is provided by a source within the contact frame and is received by the photomask and transmitted directly to the photoresist layer through openings in the mask. The mask is a photographic film and openings in the mask correspond to minimum density regions of the image on the film.

The transmitted radiation causes a change in the properties of the photoresist, e.g. a hardening or a solubilising, such that areas exposed to the radiation are physically different from those that have been hidden by the mask layer. After exposure, the photoresist is processed to remove it from areas where it is desired to etch away the copper, such that the resultant structure has regions of copper exposed and regions concealed by photoresist. The exposed areas of the copper are then etched and, after etching, the remaining photoresist is removed from the PCB to reveal the track pattern.

PCB photomasks have the most demanding of durability requirements since, unlike most other photographic films, the developed image is used many times in the imaging of the photoresist of a PCB. For instance, an imagesetter film once processed may be used once to produce a printing plate, whereas a PCB photomask may be used one thousand times in its lifetime, but due to scratch defects this may be limited to a more typical value of one hundred times. Photomasks are therefore generally protected by a much thicker outermost layer than are most imaging elements, i.e. of the order of 1.5 μm, which can lead to inefficient use of lubricant.

A variety of methods have been investigated to overcome the various injuries to which an imaging element, and particularly a photographic film, may be subjected. U.S. Pat. No. 3,121,060 describes the use of waxy esters of higher fatty alcohols and higher fatty acids, typified by modified sperm oils, as lubricants for photographic film in its unexposed form to reduce friction when passed through film magazines and to impart more permanent lubrication. There is no disclosure of the use of these esters for preventing scratches or abrasion.

In U.S. Pat. No. 6,346,369 there is disclosed an imaging element which includes a scratch-resistant outermost layer either overlying the imaging layer or on the side opposite the imaging layer, which is composed of a ductile polymer of defined physical properties. The element is disclosed to have resistance to the formation of permanent scratches that may arise during manufacture and use of the imaging product. Silicone, fatty acid and especially carnauba wax lubricants are disclosed for overcoating the scratch-resistant layer. There is no disclosure therein of the element providing resistance to abrasion.

JP 63005339 discloses a photosensitive material comprising layers on both sides of the support wherein the uppermost layers each contain at least one of an organopolysiloxane, a fluorine-containing compound and a nonionic surfactant containing a polyoxyethylene unit, with all three of the above in at least one of those layers. The expressed object is to control electrostatic charge. JP 63008642 describes a photosensitive material with good antistatic properties which includes an outermost layer containing an organic polysiloxane and a nonionic surfactant, the material having a good lubricating effect.

JP 01107255 describes a material wherein a silicone-based compound is contained in at least one layer other than the outermost layer, and the outermost layer contains a different lubricant, which may however be also be a silicone compound, the material reducing sliding friction. JP 03132754 discloses a photosensitive material having good lubricating properties and scratch resistance, capable of preventing uneven drying after processing, by incorporation of a higher fatty acid amide or ester and a silicone compound both together into the outermost surface layer of a backing layer. There is no disclosure of an abrasion-resistant effect being obtained thereby.

U.S. Pat. Nos. 5,019,491, 5,702,864 and 6,482,580 all describe the use of a siloxane in an outermost layer of an imaging element, together with another lubricant or similar addendum in that same layer.

None of the above discloses the combination in an imaging element of a lubricant providing abrasion-resistance in the outermost layer, with a lubricant in the interlayer providing scratch-resistance.

PROBLEM TO BE SOLVED BY THE INVENTION

The problem to be overcome was to find an imaging element having increased durability, especially with regard to scratch- and abrasion-(especially photoabrasion-) resistance, which retained performance and ease of manufacture, and particularly an element for use in the manufacture of PCBs or the production of printing plates, wherein problems arising from abrasions and scratches are particularly acute.

SUMMARY OF THE INVENTION

According to the present invention there is provided an imaging element comprising a support having thereon, in order, at least one imaging layer, at least one interlayer containing a lubricant which provides scratch-resistance and at least one outermost layer containing a different lubricant which provides abrasion-resistance.

In another aspect of the invention there is provided a method for processing the imaging element, which comprises developing the element as described above with an alkaline developing solution.

ADVANTAGEOUS EFFECT OF THE INVENTION

The element in accordance with the invention has improved durability, particularly with regard to both abrasion- (especially photoabrasion-) resistance and scratch-resistance. It is particularly advantageous in the production of PCBs and printing plates where the film once processed is used a considerable number of times such that any abrasions or scratches can be a significant problem.

DETAILED DESCRIPTION OF THE INVENTION

The abrasion-resistant layer for use in the invention is an outermost layer (alternatively called 'supercoat') on the front and/or back of an imaging element. The abrasion-resistance is imparted by the use of a lubricant, which is generally a silicone-based material such as disclosed, for example, in U.S. Pat. Nos. 3,294,537, 3,489,567, 3,080,317, 3,042,522, 4,004,927, 5,288,602, 4,047,958, 4,675,278, British Patent Nos. 955,061 and 1,143,118, JP 63008642, 01234843, 03123341, 04174836 and EP-A-0 534 218. Preferably the lubricant is an oligomeric or polymeric siloxane lubricant having various functional groups attached and may be co-polymerized with another compound, and has the formula (I):

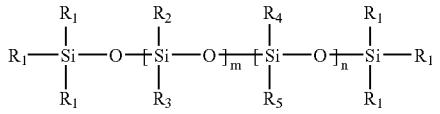

(I)

wherein each $R_1$ is independently an unsubstituted or substituted allyl group having from 1 to 8 carbon atoms or an unsubstituted or substituted alkoxy group having from 1 to 8 carbon atoms, $R_2$ $R_3$, $R_4$ and $R_5$ each represent an unsubstituted or substituted alkyl, cycloalkyl, alkoxyalkyl, arylalkyl, alkoxy, aryloxyalkyl, glycidyloxyalkyl group or aryl group, and n and m each represents a positive integer of from 0 to about 2,500, with the proviso that m and n cannot both be 0. Any substituents on those groups are those which do not otherwise interfere with the function of the siloxane as a lubricant.

Preferably each $R_1$ is the same and is an unsubstituted alkyl group, more preferably having from 1 to 3 carbon atoms, especially a methyl group, or an alkoxy group, preferably having either 1 or 2 carbon atoms. Furthermore preferably $R_2$, $R_3$, $R_4$ and $R_5$ each represent an unsubstituted alkyl group, preferably a methyl or ethyl group, m is 0 and n is an integer from 2 to about 2000, more preferably 2-500, especially 5-50.

Accordingly useful siloxanes of formula (I) include the commercially-available silicone oils exemplified by trialkyl and trialkoxy end-blocked dialkylpolysiloxanes, such as dimethylpolysiloxane, diethylpolysiloxane, trimethoxy end-blocked dimethylpolysiloxane and triethoxy end-blocked dimethylpolysiloxane. The siloxanes of formula (I) generally have a molecular weight of from about 100 to about 150,000, preferably from about 10,000 to about 20,000 and a viscosity at 25 C of from 2 to about 100,000 centistokes, preferably from 200 to 800 centistokes.

The most preferred lubricant for use in this invention is a polydimethylsiloxane, manufactured by Dow Corning under the name DC-200™, having a viscosity of 350 centistokes and an average molecular weight of 13,700 and having the formula:

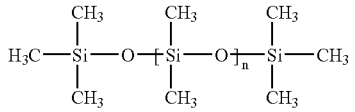

wherein n is an average of 183.

The preparation and properties of such siloxanes and specifically polydiallkylsiloxanes are well known and described, for instance, in Reuben Gutoff's article entitled "Silicone Fluid Manufacture", published in "Industrial and Engineering Chemistry", Vol. 49, pp 1807-1811.

The abrasion-resistant lubricant, such as the siloxane of formula (I), is generally added to the carrying medium or binder, which is conveniently gelatin, forming the outermost layer of the element as an aqueous dispersion in the presence of a suitable dispersing agent, preferably a non-ionic dispersing agent such as, for example, a polyethylene glycol ether, e.g. Tergitol™ 15-S-5, an allyl or aralkyl polyether alcohol, saponin or the dioctyl ester of sodium sulfosuccinic acid or an anionic surfactant, e.g. Alkanol XC™. Preferably the abrasion-resistant lubricant will be present in the aqueous dispersion in a concentration of about 8 to about 20%, preferably about 10 to about 15%, the dispersing agent will be in a concentration of about 1 to about 5% and the binder will be in a concentration of about 5 to about 10%.

The abrasion-resistant lubricant can be used in any concentration which is effective for the intended purpose, a suitable concentration in $mg/m^2$ of the imaging element being from about 5 to about 100 $mg/m^2$, preferably from about 15 to about 75 $mg/m^2$, more preferably from about 35 to about 65 $mg/m^2$.

Although the abrasion-resistant lubricant, such as a siloxane, will normally be the main lubricant in the outermost layer, another lubricant or similar addendum may also be added to that layer, provided it does not adversely affect the abrasion-resistant properties of the main lubricant.

The scratch-resistant layer is an interlayer under the outermost, supercoat, abrasion-resistant layer on the front and/or back of the imaging element. The scratch-resistance is imparted by at least one lubricant which is distinct from the one used in the abrasion-resistant layer. This may be, for example, a higher fatty acid or a derivative thereof or a higher alcohol or a derivative thereof. For example the lubricant may be a metal salt of a higher fatty acid, a higher fatty acid ester, a higher fatty acid amide, a polyhydric alcohol ester of a higher fatty acid, as disclosed in U.S. Pat. Nos. 2,454,043, 2,732,305, 2,976,148, 3,206,311, 3,933,516, 2,588,765, 3,121,060, 3,502,473 and 3,042,522, in British Patent Nos. 1,263,722, 1,198,387, 1,430,997, 1,466,304, 1,320,757, 1,320,565 and 1,320,756 and in German Patent Nos. 1,284, 295 and 1,284,294.

Preferably it will be a higher fatty acid ester of a high chain fatty acid, for example, palmitic, stearic, oleic, linoleic, linolenic or tauric acid, and in particular an ester of palmitic acid such as, for example, cetyl palmitate (hexadecanoic acid hexadecyl ester). In the present invention it is preferred to use 'Spermalube' which is a synthetic mimic of the lubricant made by whales and comprises a mixture of dodecanoic acid tetradecyl ester, tetradecanoic acid hexadecyl ester, cetyl palmitate, hexanoic acid octadecyl ester and dodecanoic acid hexadecyl ester. Generally it will be in the form of a latex or dispersion. In an aqueous dispersion the scratch-resistant lubricant will normally be present in a concentration of about 8 to about 20%, preferably about 10 to about 15%, the dispersing agent will be in a concentration of about 1 to about 5% and the binder will be in a concentration of about 5 to about 10%.

The scratch-resistant lubricant in the interlayer is generally present in a concentration in $mg/m^2$ in the imaging element of from about 5 to about 100 $mg/m^2$, preferably from about 10 to about 75 $mg/m^2$, more preferably from about 15 to about 30 $mg/m^2$.

Although the scratch-resistant lubricant, such as the fatty acid or fatty alcohol, will normally be the main lubricant in the interlayer, another lubricant or similar addendum may also be added to that layer, provided it does not adversely affect the scratch-resistant properties of the fatty acid or fatty alcohol lubricant.

The total amount of lubricant used in accordance with the invention may be very similar to that traditionally used, but the particular combination of different lubricants in the supercoat and interlayer results in significant protection from both abrasions and scratches. The imaging elements of the invention can be of many different types depending on the particular use for which they are intended. Such elements include, for example, photographic, electrostatographic, photothermographic, electrothermographic, dielectric recording and thermal-dye-transfer imaging elements. Details with respect to the composition and function of a wide variety of different imaging elements are provided in U.S. Pat. No. 5,340,676 and references described therein and the present invention can be effectively employed in conjunction with any of the imaging elements described therein.

Imaging elements can include a wide variety of supports. Details regarding supports for use in this invention are contained in Research Disclosure, Item 36544, September 1994 and Research Disclosure, Item 38597, September 1996, hereinafter 'Research Disclosures'.

Typical supports include cellulose nitrate film, cellulose acetate film, polyvinyl acetal film, polystyrene film, polyethylene terephthalate film, polyethylene naphthalate film, polycarbonate film, polyvinyl chloride film or polyolefin film, such as polyethylene or polypropylene, glass, metal, paper and polymer-coated paper. A preferred support in accordance with this invention is polyethylene terephthalate. The thickness of the support will be typically from about 25 μm to about 250 μm, preferably from about 95 μm to about 180 μm.

The imaging element of the present invention can be a simple black-and-white element comprising a support bearing a layer of light-sensitive silver halide emulsion and can be in multilayer format.

In a preferred embodiment, the imaging element of this invention is a black-and-white photographic element, such as photographic film, photographic paper or photographic glass plate, in which at least one of the imaging layers is a radiation-sensitive silver halide emulsion layer.

The light-sensitive silver halide emulsions employed in the imaging elements of this invention can include coarse, regular or fine grain silver halide crystals or mixtures thereof and can comprise, for example, silver chloride, silver bromide, silver bromoiodide, silver chlorobromide, silver chloroiodide, silver chloro-bromoiodide and mixtures thereof, but preferably comprise chlorobromide. The emulsions can be, for example, tabular grain light-sensitive silver halide emulsions and can be negative-working or direct-positive emulsions. They can form latent images predominantly on the surface of the silver halide grains or in the interior of the silver halide grains.

Such emulsion layers typically comprise a film-forming hydrophilic colloid, the most commonly used of these being gelatin, which is particularly preferred for use in this invention. Useful types of gelatins include alkali-treated gelatin (cattle bone or hide gelatin), acid-treated gelatin (pigskin gelatin) and gelatin derivatives, such as acetylated gelatin and phthalated gelatin. Other hydrophilic colloids that can be utilized alone or in combination with gelatin include dextran, gum arabic, zein, casein, pectin, collagen derivatives, collodion, agar-agar, arrowroot and albumin. Still other useful hydrophilic colloids are water-soluble polyvinyl compounds, such as polyvinyl alcohol, polyacrylamide and poly(vinylpyrrolidone). Details regarding the silver halide emulsions are contained in the Research Disclosures and the references listed therein.

The hydrophilic colloid may include a polymer, such as an acrylate, methacrylate, acrylamide or methacrylamides, e.g. an alkyl acrylate, such as methyl acrylate and butyl acrylate, 2-(methacryloyloxy)ethylacetoacetate or the sodium salt of 2-acrylamido-2-methylpropanesulfonic acid. Suitable copolymers of the above monomers may be used, e.g., a copolymer of methyl acrylate, the sodium salt of 2-acrylamido-2-methylpropane sulfonic acid and 2-methacryloyloxy)ethylacetoacetate (88:5:7 by weight) and/or a copolymer of butyl acrylate, the sodium salt of 2-acrylamido-2-methylpropanesulfonic acid and 2-(methacryloyloxy) ethylacetoacetate (90:4:6 by weight). A blend of two or more of the above polymers or copolymers may be employed, especially a blend of methyl acrylate and butyl acrylate.

In addition to the emulsion layer(s), interlayer(s) and outermost layer(s) as hereinbefore described, the elements of the present invention may contain one or more auxiliary layers conventional in imaging elements such as, for example, antihalation layers, as disclosed in the 'Research Disclosures', which may include a hydrophilic colloid and a polymer as hereinbefore described. An antihalation layer may be provided on either side of the support in order to reduce light scattering and may include any dye that is useful as a non-spectrally sensitizing dye which can absorb reflected and scattered light in a limited or a broad wavelength range.

Suitable dyes are listed in the Research Disclosures disclosed above and may be, for example, a merostyryl, pyrazole, pyrrole or thiophene or preferably an oxonol dye, more especially a pentamethine oxonol dye. In a preferred embodiment an antihalation dye is contained in the hydrophilic colloid underlayer. The dye may also be dissolved in or dispersed in the underlayer.

Other addenda conventional in the imaging art as described in the Research Disclosures may be included such as, for example, stabilizers or antifoggants, such as azaindenes, triazoles, tetrazoles, thiazoles, imidazolium salts and polyhydroxy compounds; film hardeners such as of the aldehyde, aziridine, isoxazole, acryloyl, triazine, epoxide or ethyleneimine type, or more preferably a vinylsulfone type, especially 1,3-vinyl-sulfonyl-2-propanol; anti-stain agents, anti-spot agents, absorbing materials, such as filter dyes, coating aids, plasticizers, surfactants, coalescing aids and biocides.

The emulsions are preferably chemically sensitized, for example with sulfur and gold, and preferably also spectrally sensitized with a dye, typically a trinuclear merocyanine dye, in accordance with usual practices.

More than one type of spectrally sensitized silver halide grain may be present and hence grains sensitized to different spectral regions may be present in the emulsion layer. The coating may be made by blending two or more emulsion melts containing grains of the required spectral sensitivity, allowing the production of multi-wavelength sensitive products and giving rise to manufacturing cost advantages through both material and inventory reduction. Combining the different emulsion grains within one layer can give improvements in process sensitivity over multilayer graphics nucleated systems, as described in EP-A-0 682 288.

The silver halide grains may be doped with rhodium, ruthenium, iridium, osmium or other Group VIII metals either alone or in combination, preferably at levels in the range $10^{-9}$ to $10^{-3}$, preferably $10^{-6}$ to $10^{-3}$ mole metal per mole of silver. The grains may be mono- or poly-disperse. The preferred Group VIII metals are rhodium and/or iridium and ammonium pentachlororhodate may conveniently be used.

The latent image-forming layer may contain a nucleator capable of providing high contrast development and may be, for example, as described in U.S. Pat. Nos. 4,988,604 4,994,365 and 5,288,590, EP-A-0 333 435, EP-A-1 008 902 and EP-A-1 229 328.

For example aryl sulfonamnidophenyl hydrazide nucleating agents may be used having the formula:

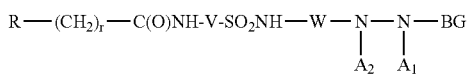

wherein BG is a blocldiing group suitable for protecting the (hydrazine) group but which is readily removable when necessary;

one of $A_1$ and $A_2$ is a hydrogen atom and the other is a hydrogen atom, an acyl group or an allyl- or aryl-sulfonyl group, any of which groups may be substituted;

V and W are independently a substituted or unsubstituted arylene group;

r is 1 to 6; and

R is selected from the class consisting of S-R', wherein R' is an unsubstituted or substituted monovalent group comprising at least three ethyleneoxy units, and a positively charged pyridinium residue substituted with from 1 to 3 unsubstituted or substituted alkyl groups, with its associated cation.

Preferably each of $A_1$ and $A_2$ is a hydrogen atom, BG is a formyl group, V and W are each an unsubstituted or substituted phenyl group, r is 1 and R is the group S-R', wherein R' is a monovalent group comprising four ethyleneoxy units, substituted with an alkyl group.

The imaging element of the invention may also contain a booster compound to enhance the ultrahigh contrast and to promote activity. Alternatively the booster compound can be present in the developer solution, as described in EP-A-1 229 328.

One class of such boosters are amines which (1) comprise at least one secondary or tertiary amino group, and (2) have an n-octanol/water partition coefficient (log P) of at least one, preferably at least three, and most preferably at least four.

Preferably such an amine contains within its structure a group comprising at least three repeating ethyleneoxy units as described in U.S. Pat. No. 4,975,354. These units are preferably directly attached to the nitrogen atom of a tertiary amino group. Particularly preferred amino compounds for inclusion in photographic materials of the invention are bis-tertiary amines having a partition coefficient of at least three and a structure represented by the formula:

$$R^1R^2N(CH_2CH_2O)_nCH_2CH_2NR^3R^4$$

wherein n is an integer from 3 to 50, and more preferably 10 to 50;

$R^1$, $R^2$, $R^3$ and $R^4$ are, independently, alkyl groups of 1 to 8 carbon atoms, or $R^1$ and $R^2$ taken together represent the atoms necessary to complete a heterocyclic ring, and/or $R^3$ and $R^4$ taken together represent the atoms necessary to complete a heterocyclic ring.

A particularly preferred booster for use in imaging elements of the invention or in the developer therefore is the booster wherein in the above formula $R^1$, $R^2$, $R^3$ and $R^4$ are each n-propyl groups and n is 14, i.e. the structure:

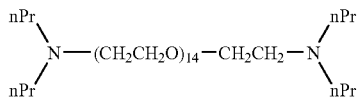

Particular amines suitable as booster compounds are listed in EP-A-0 364 166 and other types of boosters are described in U.S. Pat. Nos. 5,744,279 and 5,744,279.

The nucleator and optionally the booster compound can be incorporated in the imaging element, for example in a silver halide emulsion layer. Alternatively they can be present in a hydrophilic colloid layer of the imaging element, preferably a hydrophilic layer which is coated to be adjacent to the emulsion layer in which the effects of the nucleator are desired.

They can however be present in the imaging element distributed between or among emulsion and hydrophilic colloid layers, such as undercoating layers, interlayers and overcoating layers.

The present imaging elements are particularly suitable for exposure by red or infra-red laser diodes, light-emitting diodes or gas lasers, e.g. a helium/neon or argon laser.

The coating compositions of the invention can be applied by any of a number of well-known techniques, such as dip-coating, rod coating, blade coating, air-knife coating, gravure coating, reverse-roll coating, extrusion coating, side coating and curtain coating.

The light-sensitive silver halide contained in the imaging element can be processed following exposure to form a visible image by associating the silver halide with an aqueous alkaline medium in the presence of a developing agent contained in the medium or the element. When the imaging element contains incorporated developing agents the element can be processed in the presence of an activator, which can be identical to the developer in composition but otherwise lacking a developing agent.

The developers are typically aqueous solutions, although organic solvents, such as diethylene glycol, can also be included to facilitate the solution of organic components. The developers contain one or a combination of conventional developing agents such as, for example, a polyhydroxybenzene, such as dihydroxybenzene (hydroquinone), aminophenol, a paraphenylenediamine, ascorbic acid, erythorbic acid and derivatives thereof, pyrazolidone, pyrazolone, pyrimidine, dithionite or hydroxylamine. It is preferred to employ hydroquinone and a 3-pyrazolidone developing agent in combination or an ascorbic acid-based system. An auxiliary developing agent exhibiting super-additive properties may also be used. The pH of the developers can be adjusted with alikali metal hydroxides and carbonates, borax and other basic salts. Specific illustrative photographic developers are disclosed in the Handbook of Chemistry and Physics, 36$^{th}$ Edition, under the title "Photographic Formulae" at page 30001 et seq. and in "Processing Chemicals and Formulas" 6$^{th}$ Edition, published by Eastman Kodak Company (1963).

The invention will further be described with reference to the following examples, but is not to be construed as being limited thereto.

EXAMPLE 1 (COMPARATIVE)

The film coating prepared consisted of a polyethylene terephthalate (ESTAR™) support on which was coated an antihalation underlayer, an image-forming emulsion layer, an interlayer and a protective gelatin supercoat. The layers were hardened with a bis-vinylsulfone hardener.

Antihalation Underlayer The underlayer consisted of 1.00 g gelatin/m$^2$ and a copolymer of methyl and butyl acrylate at 1.00 g/m$^2$. The layer also contained an amine booster at 61.5 mg/m$^2$ of structure:

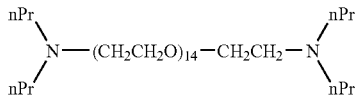

a solid particle antihalation dye at 220 mg/m$^2$of structure:

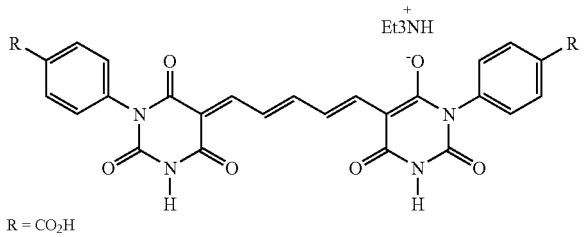

and an anti-spot agent, Tiron, was added at a coverage of 98 mg/m$^2$.

Image-Forming Emulsion Layer

The latent image-forming emulsion layer consisted of a 70:30 chlorobromide cubic monodispersed emulsion (0.215 μm mean edge length) doped with a rhodium salt, chemically sensitized with sulfur and gold and spectrally sensitized with 190 mg/Ag mol of a trinuclear merocyanine sensitizing dye of structure:

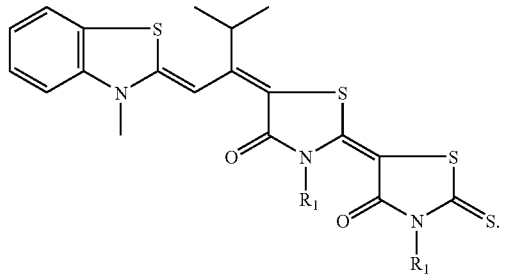

The emulsion was coated at a silver coverage of 3.15 g/m$^2$ in a matrix of 1.94 g/m$^2$ gelatin and 1.155 g/m$^2$ of a copolymer of methyl and butyl acrylate. Other addenda included 2-mercaptomethyl-5-carboxy-4-hydroxy-6-methyl-1,3,3a,7-tetraazaindene, 1-(3-acetamidophenyl)-5-mercaptotetrazole and 2,3-dihydro-2-thioxo-4-thiazoleacetic acid. The layer also contained 12.5 g/m$^2$ of a nucleator compound of structure:

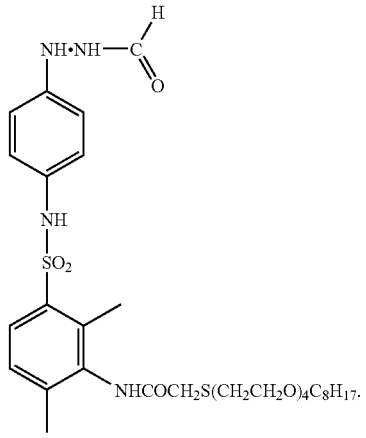

Interlayer

The interlayer was coated at a gelatin laydown of 0.935 g/m$^2$ and the layer contained hydroquinone at 162 mg/m$^2$.

Supercoat

The supercoat was coated at a gelatin laydown of 0.565 g/m$^2$. The layer contained surfactants (Lodyne™ S-100 and Triton™ X200) to enable coating, a lubricant 'Spermalube' at 60 mg/m$^2$ and a solid particle safelight protection dye at 140 g/m$^2$ of structure:

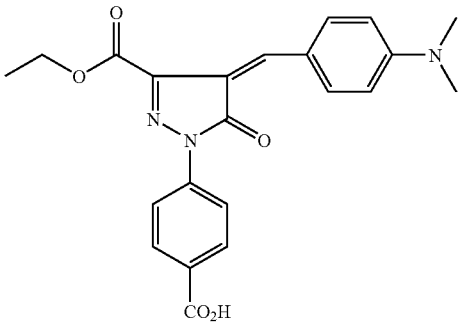

The 'Spermalube' comprised
0.26% dodecanoic acid tetradecyl ester
21.26% tetradetanoic acid hexadecyl ester
32.13% cetyl palmitate (hexadecanoic acid hexadecyl ester)
28.43% hexanoic acid octadecyl ester and
8.01% dodecanoic acid hexadecyl ester.

EXAMPLE 2 (COMPARATIVE)

This film was prepared in the same way as the film in Example 1 except that 60 mg/m$^2$ of DC-200™ 350 CST, a polymeric dimethylsiloxane of average molecular weight of 13,700, was used in the supercoat instead of the 'Spermalube'.

EXAMPLE 3 (INVENTIVE)

This film was prepared in the same way as the film in Example 1 except that 60 mg/m$^2$ of DC-200™ was used in the supercoat and the interlayer contained 15 mg/m$^2$ of 'Spermalube' lubricant.

EXAMPLE 4 (INVENTIVE)

This film was prepared in the same way as the film in Example 1 except that 60 mg/m$^2$ of DC-200™ was used in the supercoat and the interlayer contained 30 mg/m$^2$ of 'Spermalube' lubricant.

The samples were exposed to light, followed by development in KODAK™ ACCUMAX™ 2000RA developer (diluted 1+2) at 35 C for 45 s, followed by conventional fixing, washing and drying. The films were then conditioned at 50%, RH 21 C for a minimum of 4 h (overnight).

The films were tested for durability by being abraded on a Taber Linear Abraser (model 5700), manufactured by TABER™ INDUSTRIES (455 Bryant Street North Tonawanda, N.Y. 14120) using a CS-10 'Wearaser' abrading head with a total load of 1100 g at 60 cycles/min, for a total of 30 cycles and the test was repeated 3 times. The density of the unabraded surface ($D_{max}$) was measured and the density of the abraded area measured 15 times over representative parts of the abrasion. The average of abraded density was compared to the $D_{max}$ such that the percentage density remaining could be determined, wherein 100% would indicate no damage. The films were also compared to a commercially-available film, Fuji IPR-175.

TABLE 1

| Film | Supercoat lubricant: mg/m$^2$ | Interlayer lubricant: mg/m$^2$ | Comment |
|---|---|---|---|
| Example 1 | 'Spermalube': 60 | None | Comparison |
| Example 2 | DC-200: 60 | None | Comparison |
| Example 3 | DC-200: 60 | 'Spermalube': 15 | Invention |
| Example 4 | DC-200: 60 | 'Spermalube': 30 | Invention |

TABLE II

| Film | Density Remaining | Comment |
|---|---|---|
| Example 1 | 39% | Poor |
| Example 2 | 73% | Good |
| Example 3 | 83% | Very Good |
| Example 4 | 85% | Very Good |
| Fuji IPR-175 | 20% | Very Poor |

It will be seen from the above that, in the control examples, the addition of the 'Spermalube' lubricant to the supercoat provided poor abrasion resistance, whereas its replacement with a siloxane lubricant produced an improved result. However the addition of a siloxane lubricant to the supercoat and 'Spermalube' to the interlayer further improved the resistance to abrasion. It can be seen that the commercially-available film had very poor abrasion resistance.

The samples were then exposed to a repetitive scratch test which involved loading a 120° diamond stylus with an 80 g load and then dragging this stylus over the film sample to induce a scratch. The test was repeated over the same scratch up to four times. The scratch was examined along its length for damage, i.e. complete removal of silver, wherein a score of 100% represented total removal.

TABLE III

| Film | Silver Lost Single Scratch | Silver Lost Four Scratches | Comment |
|---|---|---|---|
| Example 1 | 0% | 100% | Very Poor |
| Example 2 | 0% | 100% | Very Poor |
| Example 3 | 0% | 39% | Good |
| Example 4 | 2% | 45% | Good |
| Fuji IPR-175 | 0% | 41% | Good |

The results in TABLE III show that, after four scratches, the control examples including either 'Spermalube' or a siloxane in the supercoat produced a total removal of silver. When the siloxane was present in the supercoat and the 'Spermalube' in the interlayer, the repetitive scratch-resistance matched, if not bettered, the commercially-available film.

Using the Taber Linear Abraser with a load of 1100 g it was possible to investigate the sensitivity of the films to pre-process abrasion. The film was abraded in the absence of light and then processed as previously described, whereupon a dark line or series of fine lines was produced. The test was repeated twice and the density of each patch measured 15 times to obtain an average density measurement, a high density being indicative of poor resistance to pre-process abrasion.

TABLE 1V

| Film | Density | Comment |
|---|---|---|
| Example 1 | 1.56 | Poor |
| Example 2 | 0.50 | Good |
| Example 3 | 0.34 | Very Good |
| Example 4 | 0.39 | Very Good |
| Fuji IPR-175 | 0.97 | Poor |

As is apparent from TABLE IV, the examples using elements in accordance with the invention, with the two different lubricants in the supercoat and interlayer, had a superior resistance to pre-process abrasion compared to both the individual lubricants and to the commercially-available film.

EXAMPLES 5-16

Using the same materials as above, three- or four-layer coatings were prepared. For the three-layer examples the supercoat was coated with a gelatin coverage of 1.5 g/m$^2$ and the safelight dye, hydroquinone and wetting agents were as described earlier, the amount and type of lubricant being given in TABLE V. For the four-layer coatings the supercoat was split into two layers, the total thickness of which therefore was equal to the supercoat in the three-layer format. The safelight dye and hydroquinone were retained in the new interlayer, the wetting agents remaining in the new supercoat. The amount of gelatin in the new supercoat was 0.5 g/m$^2$, whilst in the new interlayer it was 1.0 g/m$^2$.

The same lubricants were used in either the supercoat or interlayer as described in TABLE V, wherein 'Spermalube' is abbreviated to SP and poly-dimethylsiloxane DC-200™ is abbreviated to DC. The films were subjected to the photoabrasion test as described previously, except that a lighter load of 850 g was used, so that there is no correlation between the values in Tables IV and V.

TABLE V

| Film | Layers | Supercoat: mg/m$^2$ | Interlayer: mg/m$^2$ | Photoabrasion Density | Comp/Inv | Comment |
|---|---|---|---|---|---|---|
| Ex. 5 | 3 | SP: 45 | N/A | 0.614 | Comp. | Very Poor |
| Ex. 6 | 3 | DC: 45 | N/A | 0.151 | Comp. | Poor |
| Ex. 7 | 3 | DC: 22.5 + SP: 22.5 | N/A | 0.242 | Comp. | Poor |
| Ex. 8 | 3 | DC: 30 + SP: 15 | N/A | 0.248 | Comp. | Poor |
| Ex. 9 | 4 | none | SP: 60 | 0.690 | Comp. | Very Poor |
| Ex. 10 | 4 | DC: 45 | none | 0.033 | Comp. | Fair |
| Ex. 11 | 4 | DC: 45 | SP: 10 | 0.023 | Inv. | Good |
| Ex. 12 | 4 | DC: 45 | SP: 20 | 0.026 | Inv. | Good |
| Ex. 13 | 4 | DC: 45 | SP: 30 | 0.024 | Inv. | Good |
| Ex. 14 | 4 | DC: 45 | SP: 60 | 0.007 | Inv. | Very Good |
| Ex. 15 | 4 | SP: 45 | SP: 10 | 0.426 | Comp. | Poor |
| Ex. 16 | 4 | SP: 45 | SP: 30 | 0.408 | Comp. | Poor |

As seen in TABLE V, a three-layer format with no interlayer, as in Examples 1 to 8, showed poor or very poor photoabrasion resistance with either of the lubricants alone or in combination.

In the four-layer format with no lubricant in the supercoat (Example 9) again there was very poor photoabrasion resistance. However it will be seen that even a small amount of 'Spermalube' in the interlayer added to the siloxane in the supercoat (Example 11) made some improvement in photoabrasion resistance, compared to Example 10 with no lubricant in the interlayer. It will be noted that an acceptable density of less than 0.03 was only achieved with elements in accordance with the present invention, with the two different lubricants in the supercoat and interlayer.

The patents and publications referred to herein are incorporated by reference in their entirety.

The present invention has been described in detail with reference to preferred embodiments. It will be understood by one skilled in the art that variations and modifications can be made within the spirit and scope of the invention.

The invention claimed is:

1. An imaging element comprising a support having thereon, in order, at least one imaging layer, at least one interlayer containing a lubricant which provides scratch-resistance, which is a higher fatty acid or a derivative thereof or a higher alcohol or a derivative thereof and at least one outermost layer containing a lubricant which provides abrasion-resistance which is different from the lubricant providing scratch resistance.

2. The element of claim 1 wherein said lubricant which provides abrasion-resistance is a silicone-based lubricant.

3. The element of claim 2 wherein said lubricant which provides abrasion-resistance is a siloxane having the formula (I):

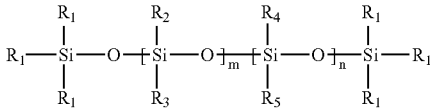

(I)

wherein each $R_1$ is independently an unsubstituted or substituted alkyl group having from 1 to 8 carbon atoms or an unsubstituted or substituted alkoxy group having from 1 to 8 carbon atoms, $R_2$ $R_3$, $R_4$ and $R_5$ each represents an unsubstituted or substituted alkyl, cycloalkyl, alkoxyalkyl, arylalkyl, alkoxy aryloxyalkyl, glycidyloxyalkyl group or aryl group, and n and m each represents a positive integer of from 0 to 2,500, with the proviso that both m and n cannot be 0.

4. The element of claim 3 wherein in formula (I), each $R_1$ is the same and is an unsubstituted alkyl group having from 1 to 3 carbon atoms or an alkoxy group having either 1 or 2 carbon atoms.

5. The element of claim 3 wherein in formula (I) $R_2$, $R_3$, $R_4$ and $R_5$ each represents an unsubstituted alkyl group.

6. The element of claim 3 wherein m is 0 and n is an integer from 2-500.

7. The element of claim 3 wherein said lubricant which provides abrasion-resistance has a viscosity of 350 centistokes and an average molecular weight of 13,700 and has the formula:

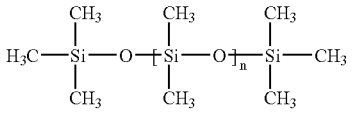

wherein n is an average of 183.

8. The element of claim 1 wherein said lubricant which provides abrasion-resistance is present in a concentration of from about 35 to about 65 mg/m$^2$.

9. The element of claim 1 wherein said lubricant providing scratch resistance is a metal salt of a higher fatty acid, a higher fatty acid ester, a higher fatty acid amide or a polyhydric alcohol ester of a higher fatty acid.

10. The element of claim 9 wherein said lubricant is a derivative of a fatty acid selected from the class consisting of palmitic, stearic, oleic, linoleic, linolenic or tauric acids.

11. The element of claim 10 wherein said lubricant comprises 'Spermalube'.

12. The element of claim 1 wherein said lubricant which provides scratch-resistance is present in a concentration of from about 15 to about 30 mg/$m^2$.

13. The element of claim 1 wherein said element is selected from the class consisting of photographic, electrostatographic, photothermographic, electrothermographic, dielectric recording and thermal-dye-transfer imaging elements.

14. The element of claim 13 wherein said element is a black-and-white photographic element in which at least one of the imaging layers comprises a radiation-sensitive silver halide emulsion layer.

15. The element of claim 14 wherein said silver halide emulsion comprises a silver chlorobromide emulsion.

16. The element of claim 1 wherein said element includes a nucleator capable of providing high contrast development in a latent-image forming layer.

17. The element of claim 16 which includes a booster.

18. A method for processing the imaging element of claim 1, which comprises developing said element with an alkaline developing solution.

19. The method of claim 18 wherein said lubricant which provides abrasion-resistance is a siloxane having the formula (I):

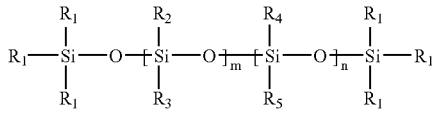

(I)

wherein each $R_1$ is independently an unsubstituted or substituted alkyl group having from 1 to 8 carbon atoms or an unsubstituted or substituted alkoxy group having from 1 to 8 carbon atoms, $R_2$ $R_3$, $R_4$ and $R_5$ each represents an unsubstituted or substituted alkyl, cycloalkyl, alkoxyalkyl, arylalkyl, alkoxy aryloxyalkyl, glycidyloxyalkyl group or aryl group, and n and m each represents a positive integer of from 0 to 2,500, with the proviso that both m and n cannot be 0.

20. The method of claim 18 wherein said lubricant which provides scratch resistance is a derivative of a fatty acid selected from the class consisting of palmitic, stearic, oleic, linoleic, linolenic or tauric acids.

* * * * *